US010047771B2

(12) United States Patent
Tanaka et al.

(10) Patent No.: US 10,047,771 B2
(45) Date of Patent: Aug. 14, 2018

(54) CONSTRUCTION MACHINE

(71) Applicant: KOBELCO CONSTRUCTION MACHINERY CO., LTD., Hiroshima-shi (JP)

(72) Inventors: Hidenori Tanaka, Hiroshima (JP); Kensuke Ishikura, Hiroshima (JP); Koji Ueda, Hiroshima (JP); Takaaki Izuka, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 467 days.

(21) Appl. No.: 14/802,277

(22) Filed: Jul. 17, 2015

(65) Prior Publication Data

US 2016/0032947 A1 Feb. 4, 2016

(30) Foreign Application Priority Data

Jul. 30, 2014 (JP) ..... 2014-155140

(51) Int. Cl.

| | |
|---|---|
| ***F15B 13/01*** | (2006.01) |
| ***E02F 3/43*** | (2006.01) |
| ***E02F 9/22*** | (2006.01) |
| ***F15B 11/10*** | (2006.01) |
| ***F15B 13/042*** | (2006.01) |
| ***F15B 21/08*** | (2006.01) |
| ***F15B 11/00*** | (2006.01) |

(52) U.S. Cl.

CPC ..... *F15B 13/01* (2013.01); *E02F 3/435* (2013.01); *E02F 9/2203* (2013.01);

(Continued)

(58) Field of Classification Search

CPC ..... F15B 11/003; F15B 13/0426; F15B 13/0431; F15B 13/01; F15B 2211/20576; F15B 2211/30565

(Continued)

(56) References Cited

U.S. PATENT DOCUMENTS 4,476,679 A * 10/1984 Sato ..... E02F 9/2217 60/429
6,955,115 B1 * 10/2005 A'Hearn ..... E02F 9/2203 91/437

(Continued)

FOREIGN PATENT DOCUMENTS

EP 2 039 945 A1 3/2009
JP 2008-274988 11/2008

OTHER PUBLICATIONS

Extended European Search Report dated Dec. 2, 2015 in Patent Application No. 15177232.4.

*Primary Examiner* — Michael Leslie
*Assistant Examiner* — Matthew Wiblin
(74) *Attorney, Agent, or Firm* — Oblon, McClelland, Maier & Neustadt, L.L.P.

(57) ABSTRACT

A hydraulic excavator includes control valves connected to a head-side chamber of a boom cylinder, an operating unit configured to switch the control valves, lock valves each provided between the head-side chamber and each of the control valves, and an operation control unit that controls the operation of the lock valves. The lock valves each have a valve element that is configured to move between a locking position at which the discharge of hydraulic oil from the head-side chamber is restricted and an unlocking position at which the discharge of the hydraulic oil from the head-side chamber is allowed. The operation control unit controls the operation of the lock valves so that the valve elements move from the locking position to the unlocking position at different points in time when the operating unit is operated.

6 Claims, 6 Drawing Sheets

(52) U.S. Cl.
CPC ..... *E02F 9/2242* (2013.01); *E02F 9/2267* (2013.01); *E02F 9/2285* (2013.01); *E02F 9/2292* (2013.01); *F15B 11/003* (2013.01); *F15B 11/10* (2013.01); *F15B 13/042* (2013.01); *F15B 21/08* (2013.01); *F15B 2211/20576* (2013.01); *F15B 2211/3059* (2013.01); *F15B 2211/30515* (2013.01); *F15B 2211/30565* (2013.01)

(58) Field of Classification Search
USPC ..... 91/16, 18, 6
See application file for complete search history.

(56) References Cited

U.S. PATENT DOCUMENTS

| | | | | |
|---|---|---|---|---|
| 2008/0219846 | A1* | 9/2008 | Annebique | F04D 29/362 416/154 |
| 2009/0145123 | A1* | 6/2009 | Hwang | F15B 11/003 60/466 |
| 2010/0000209 | A1* | 1/2010 | Wada | E02F 9/2203 60/413 |
| 2014/0033689 | A1* | 2/2014 | Opdenbosch | F15B 7/006 60/325 |
| 2014/0158235 | A1* | 6/2014 | Suk | E02F 9/2242 137/565.11 |

* cited by examiner

CONSTRUCTION MACHINE

TECHNICAL FIELD

The present invention relates to a construction machine having a driven body that can rotate about a horizontal axis in raising and lowering directions.

BACKGROUND ART

Conventionally, a construction machine including a boom as the driven body, a boom cylinder that rotates and drives the boom, a hydraulic pump that supplies hydraulic oil to the boom cylinder, and a control valve that controls the supply of the hydraulic oil to the boom cylinder and the discharge of hydraulic oil from the boom cylinder is known.

In the construction machine, a lock valve for locking the boom so as not to rotate in the lowering direction due to its own weight when the work of the construction machine with the boom raised is suspended (when the control valve is operated to a neutral position) is provided.

The lock valve is provided between the control valve and the boom cylinder in order to prevent leakage of the hydraulic oil in the control valve.

As in a construction machine disclosed in Japanese Unexamined Patent Application Publication No. 2008-274988 illustrated in FIG. 8, a plurality of control valves may be connected to a boom cylinder.

Specifically, the construction machine includes first and second hydraulic pumps 101A and 101B that supply hydraulic oil to a boom cylinder 100 and a valve unit 102 that controls the supply of the hydraulic oil to the boom cylinder 100 and the discharge of the hydraulic oil from the boom cylinder 100.

The valve unit 102 includes a first control valve 103A connected to the first hydraulic pump 101A, a second control valve 103B connected to the second hydraulic pump 101B, and a valve body 104 that stores both control valves 103A and 103B and has passages R100 to R103 described later.

The first control valve 103A is connected to the first hydraulic pump 101A through a pump passage R100 and the second control valve 103B is connected to the second hydraulic pump 101B through a pump passage R103.

Moreover, both control valves 103A and 103B are connected to a head-side chamber of the boom cylinder 100 through a head-side passage R101 and a rod-side chamber of the boom cylinder 100 through a rod-side passage R102.

For example, when both control valves 103A and 103B are switched to a boom raising position, the hydraulic oil output from both hydraulic pumps 101A and 101B through both control valves 103A and 103B converges in the head-side passage R101 and is guided to the head-side chamber of the boom cylinder 100.

Here, since the head-side passage R101 and the rod-side passage R102 are formed inside the valve body 104, the cross-sectional area of both passages R101 and R102 is limited. As a result, there is a problem in that the pressure loss in the hydraulic oil increases in the converging portion of the head-side passage R101 and the rod-side passage R102.

Thus, in order to suppress the pressure loss, parallel passages respectively connected to both control valves 103A and 103B may be formed in the valve body 104 and these passages and the boom cylinder 100 may be connected by a converging hydraulic pipeline (external hydraulic pipeline).

In such a configuration, when the lock valve described above is employed, the lock valve is connected between the valve body 104 and the converging hydraulic pipeline. That is, the lock valve is connected to each of the two control valves 103A and 103B.

The lock valve includes a valve element capable of moving between a locking position at which the discharge of the hydraulic oil from the boom cylinder is restricted and an unlocking position at which the discharge of the hydraulic oil from the boom cylinder is allowed. The valve element is disposed at the locking position in a work suspended state and moves to the unlocking position before the boom cylinder is driven.

However, when the valve element moves from the locking position to the unlocking position, a space in which the hydraulic oil can flow is formed in the passage of the hydraulic oil by movement of the valve element. Due to this, when the hydraulic oil flows into this space, the rod of the boom cylinder moves and a shock resulting from this movement occurs.

In particular, as described above, when a plurality of (two) lock valves is provided with respect to a boom cylinder and these valve elements move to the unlocking position at the same time, the shock may increase and an operator may experience unpleasant feeling.

SUMMARY OF INVENTION

An object of the present invention is to provide a construction machine capable of reducing unpleasant feeling that an operator may experience by adjusting the moving timing of the valve elements of a plurality of lock valves.

In order to solve the problems, the present invention provides a construction machine including: a driven body configured to rotate about a horizontal axis in a raising direction and a lowering direction; a hydraulic cylinder that rotates and drives the driven body; a plurality of switching valves that is connected to, among a rod-side chamber and a head-side chamber of the hydraulic cylinder, a discharge-side chamber from which hydraulic oil is discharge during rotation of the driven body in the lowering direction, and that is configured to switch between a discharge state in which the discharge of the hydraulic oil from the discharge-side chamber is allowed and a stopped state in which the discharge of the hydraulic oil is stopped; an operating unit configured to switch the plurality of switching valves from the stopped state to the discharge state; a plurality of lock valves each provided between each of the plurality of switching valves and the discharge-side chamber in order to lock the rotation of the driven body in the lowering direction in a non-operating state of the operating unit; and an operation control unit that controls the operation of the plurality of lock valves, wherein each of the plurality of lock valves includes a valve element configured to move between a locking position at which the discharge of the hydraulic oil from the discharge-side chamber is restricted and an unlocking position at which the discharge of the hydraulic oil from the discharge-side chamber is allowed, and the operation control unit controls the operation of the plurality of lock valves so that the plurality of valve elements moves from the locking position to the unlocking position at different points in time when the operating unit is operated.

According to the present invention, it is possible to reduce unpleasant feeling that an operator may experience by adjusting the moving timing of the valve elements of a plurality of lock valves.

DESCRIPTION OF EMBODIMENTS

Hereinafter, embodiments of the present invention are described with reference to the accompanying drawings. The following embodiments are specific examples of the present invention and are not intended to restrict the technical scope of the present invention.

First Embodiment (FIGS. 1 to 6)

Figure 1:
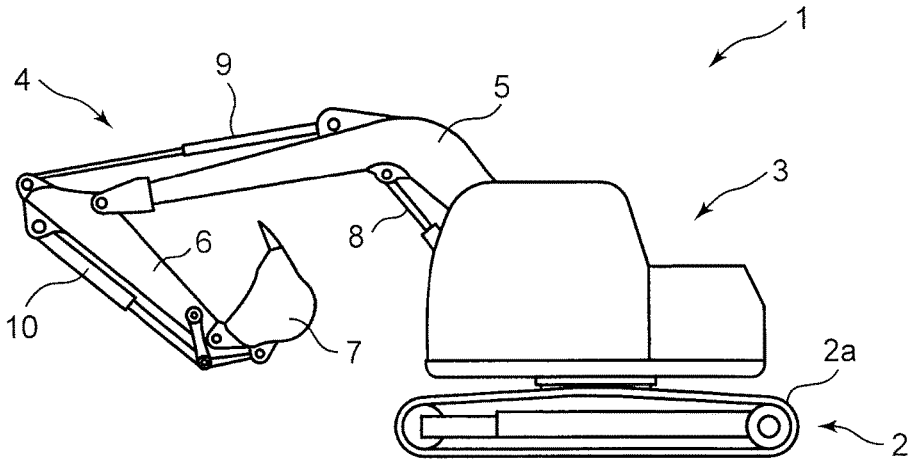
FIG. 1 is a side view illustrating an entire configuration of a hydraulic excavator according to a first embodiment of the present invention.

Referring to FIG. 1, a hydraulic excavator 1 according to a first embodiment of the present invention includes a lower traveling body 2 having a crawler 2*a*, an upper swinging body 3 provided on the lower traveling body 2 so as to swing, and a working attachment 4 attached to the upper swinging body 3.

The working attachment 4 includes a boom 5 attached to the upper swinging body 3 so as to rotate about a horizontal axis in raising and lowering directions, an arm 6 attached to a distal end of the boom 5 so as to rotate about the horizontal axis, and a bucket 7 attached to a distal end of the arm 6 so as to rotate.

Moreover, the working attachment 4 includes a boom cylinder 8 that drives the boom 5 so as to rotate in the raising and lowering direction with respect to the upper swinging body 3, an arm cylinder 9 that drives the arm 6 so as to rotate with respect to the boom 5, and a bucket cylinder 10 that drives the bucket 7 so as to rotate with respect to the arm 6.

Figure 2:
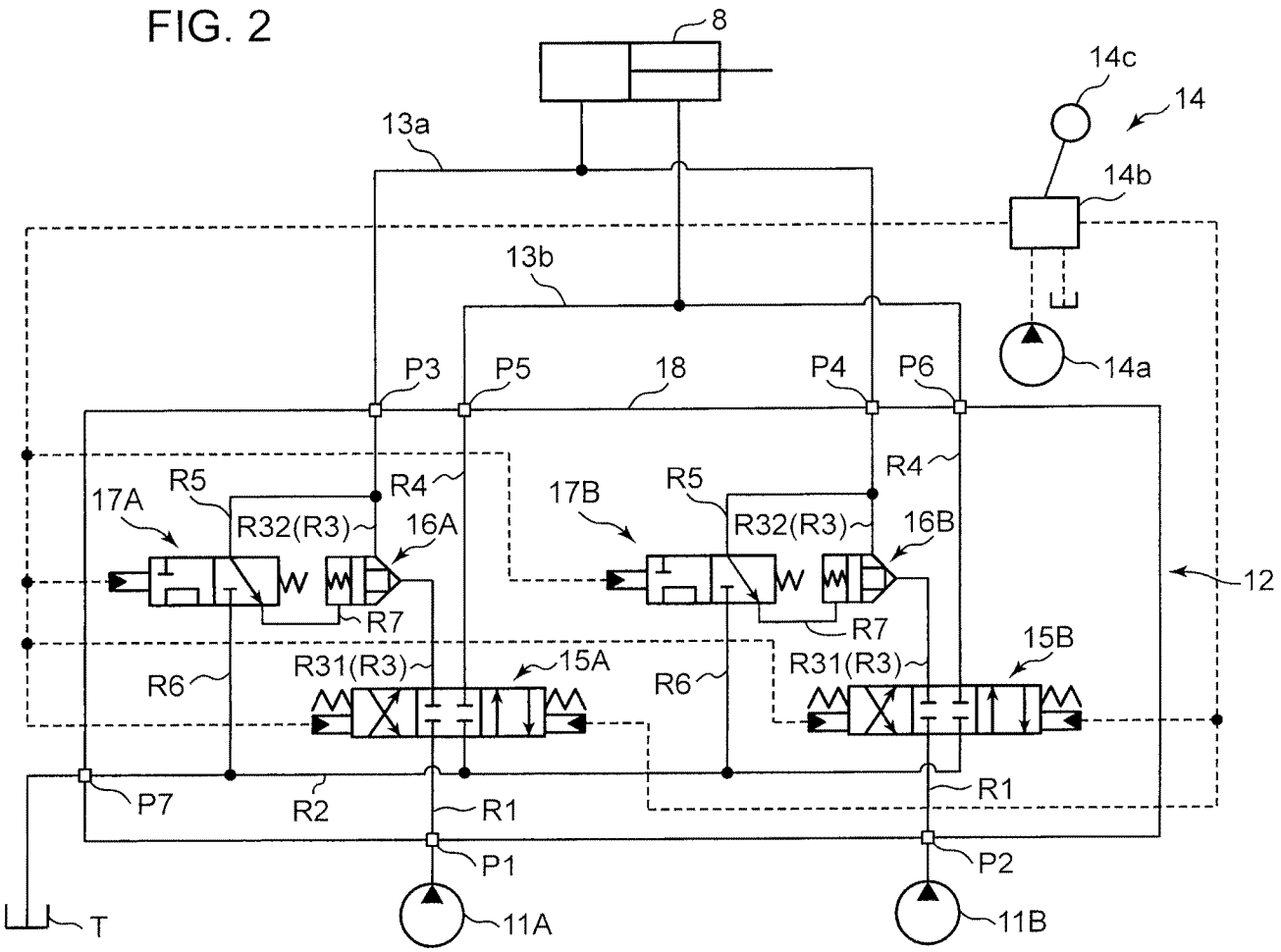
FIG. 2 is a circuit diagram illustrating a hydraulic system provided in the hydraulic excavator of FIG. 1.

Hereinafter, referring to FIG. 2, a hydraulic system provided in the upper swinging body 3 in order to control driving of the boom cylinder 8 will be described. In FIG. 2, hydraulic actuators other than the boom cylinder 8 are omitted.

The hydraulic system includes first and second pumps 11A and 11B for supplying hydraulic oil to the boom cylinder 8, a valve unit 12 for controlling the supply of the hydraulic oil to the boom cylinder 8 and the discharge of the hydraulic oil from the boom cylinder 8, a head-side pipeline 13*a* and a rod-side pipeline 13*b* for connecting the valve unit 12 and the boom cylinder 8, and an operating unit 14 for operating valves formed in the valve unit 12.

The first pump 11A is connected to a pump port P1 of the valve unit 12 through a hydraulic pipeline (not designated by reference numeral). The hydraulic oil discharged from the first pump 11A is introduced into the valve unit 12 through the pump port P1 and is guided to the boom cylinder 8 through an actuator port P3 or P5 of the valve unit 12.

The second pump 11B is connected to the pump port P2 of the valve unit 12 through a hydraulic pipeline (not designated by reference numeral). The hydraulic oil discharged from the second pump 11B is introduced into the valve unit 12 through the pump port P2 and is guided to the boom cylinder 8 through an actuator port P4 or P6 of the valve unit 12.

The head-side pipeline 13*a* connects the actuator ports P3 and P4 of the valve unit 12 to a head-side chamber of the boom cylinder 8. The rod-side pipeline 13*b* connects the actuator ports P5 and P6 of the valve unit 12 to a rod-side chamber of the boom cylinder 8.

In this way, the hydraulic oil discharged from the valve unit 12 through the actuator ports P3 to P6 converges in the head-side pipeline 13*a* or the rod-side pipeline 13*b* and is guided to the head-side chamber or the rod-side chamber of the boom cylinder 8.

On the other hand, the hydraulic oil discharged from the boom cylinder 8 is guided into the valve unit 12 through the head-side pipeline 13*a* or the rod-side pipeline 13*b* and is discharged from the valve unit 12 through a tank port P7 to be guided to a tank T.

The valve unit 12 includes a first control valve (switching valve) 15A, a first lock valve 16A, and a first release valve 17A connected to the first pump 11A, a second control valve (switching valve) 15B, a second lock valve 16B, and a second release valve 17B connected to the second pump 11B, and a valve body 18 which accommodates these valves 15A to 17B and has passages R1 to R7 (described later).

A configuration connected to the first pump 11A will be mainly described because the configuration is the same as a configuration connected to the second pump 11B.

The first control valve 15A controls the supply of hydraulic oil to the boom cylinder 8 and the discharge of hydraulic oil from the boom cylinder 8. The first control valve 15A can switch between a neutral position (an intermediate position in the drawing: a stopped state), a boom lowering position (the left position in the drawing: an discharge state) in which the boom 5 is driven in a lowering direction (a contraction direction of the boom cylinder 8), and a boom raising position (the right position in the drawing) in which the boom 5 is driven in a raising direction (an extension direction of the boom cylinder 8).

In a non-operating state of the operating unit 14 described later, the first control valve 15A is biased to the neutral position by a biasing member (not designated by reference numeral). Moreover, the first control valve 15A strokes toward the boom raising position or the boom lowering position according to an operation amount of the operating unit 14.

Further, the first control valve 15A is connected to the pump port P1 through a pump passage R1, to the tank port P7 through a tank passage R2, and to the actuator port P5 through a rod-side passage R4.

The first lock valve 16A is configured to lock the boom 5 so that the boom 5 does not rotate in the lowering direction with its own weight when the working of the hydraulic excavator 1 is suspended (the first control valve 15A is operated to the neutral position) with the boom 5 raised.

The first lock valve 16A is provided between the first control valve 15A and a head-side chamber (a discharge-side chamber from which hydraulic oil is discharged when the boom 5 is lowered) of the boom cylinder 8. That is, the first lock valve 16A is provided in an intermediate portion of the head-side passage R3 that connects the first control valve 15A and the actuator port P3. Hereinafter, a portion of the head-side passage R3 disposed closer to the first control valve 15A than the lock valve 16A will be referred to as a control valve-side passage R31 and a portion of the head-side passage R3 disposed closer to the actuator port P3 than the lock valve 16A will be referred to as a cylinder-side passage R32. A specific configuration of the first lock valve 16A will be described later.

The first release valve 17A is configured to release the lock state created by the first lock valve 16A. The first release valve 17A is connected to the cylinder-side passage R32 through a locking passage R5, to the tank passage R2 through a releasing passage R6, and to the first lock valve 16A through a communication passage R7. A specific configuration of the first release valve 17A will be described later.

The operating unit 14 includes a pilot pump 14*a*, an operating lever 14*c* for raising and lowering the boom 5, and a remote control valve 14*b* that can output a pilot pressure corresponding to an operating direction and an operation amount of the operating lever 14*c*.

A boom-raising pilot pressure is applied to boom-raising pilot ports (the right-side ports in FIG. 2) of both control valves 15A and 15B, and a boom-lowering pilot pressure is applied to boom-lowering pilot ports (the left-side ports in FIG. 2) of both control valves 15A and 15B, both lock valves 16A and 16B, and both release valves 17A and 17B.

Hereinafter, the operation of the first lock valve 16A and the first release valve 17A will be described with reference to FIGS. 2 to 4.

The first lock valve 16A includes a valve element 16*a* configured to move between a locking position (the position illustrated in FIG. 3) in which the discharge of the hydraulic oil from the head-side chamber of the boom cylinder 8 is restricted and an unlocking position (the position illustrated in FIG. 4) in which the discharge of the hydraulic oil from the head-side chamber is allowed and a spring (biasing member) 16*b* that biases the valve element 16*a* toward the locking position.

The pressure of the hydraulic oil in the communication passage R7 and the biasing force of the spring 16*b* are applied to one end surface 16*f* (hereinafter referred to as a base end surface 160 in the moving direction of the valve element 16*a*, and the pressure of the hydraulic oil in the control valve-side passage R31 is applied to the other end surface 16*g* (hereinafter referred to as a distal end surface 16*g*) in the moving direction of the valve element 16*a*. The area of the base end surface 16*f* is larger than the area of the distal end surface 16*g*.

Figure 3:
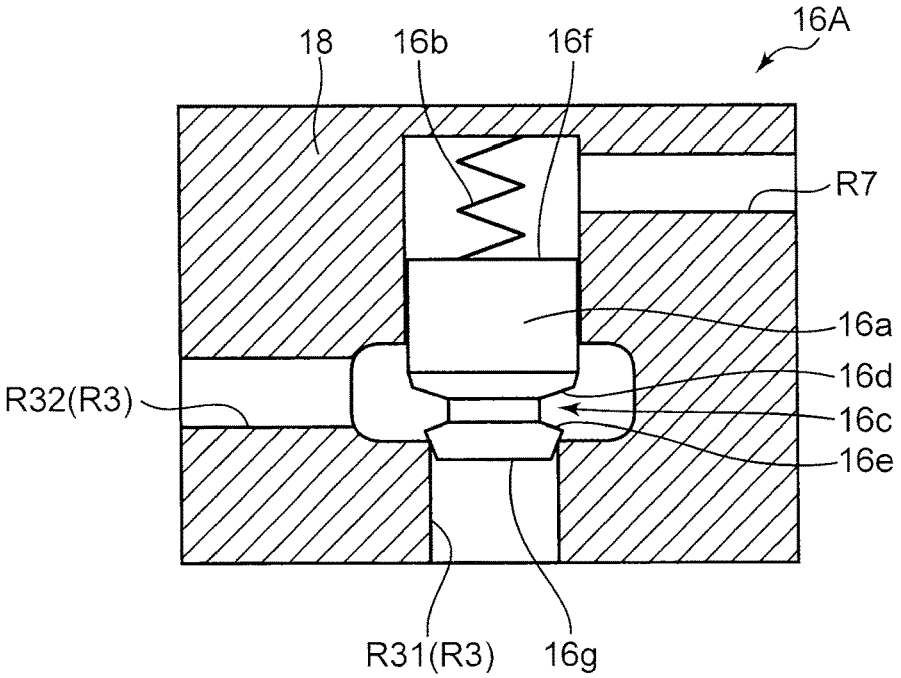
FIG. 3 is a cross-sectional view illustrating a schematic configuration of a lock valve illustrated in FIG. 2 and illustrating a state in which a valve element is disposed at a locking position.

Moreover, as illustrated in FIG. 3, in a state in which the valve element 16*a* is moved to the locking position, the side surface of the distal end of the valve element 16*a* makes contact with the inner surface of the control valve-side passage R31, whereby the control valve-side passage R31 and the cylinder-side passage R32 are blocked. On the other hand, as illustrated in FIG. 4, in a state in which the valve element 16*a* is moved to the unlocking position, the distal end surface 16*g* of the valve element 16*a* moves into the cylinder-side passage R32, whereby the control valve-side passage R31 communicates with the cylinder-side passage R32.

Further, the side surface of the valve element 16*a* is depressed along the entire circumference whereby a groove 16*c* is formed. The groove 16*c* is formed at such a position that the groove 16*c* is disposed in the cylinder-side passage R32 when the valve element 16*a* is moved to the locking position. Moreover, the area of a first inner surface 16*d* that forms a base-end-side inner surface of the groove 16*c* is larger than the area of a second inner surface 16*e* that forms a distal-end-side inner surface of the groove 16*c* and is smaller than the area of the base end surface 16*f*.

As illustrated in FIG. 2, the first release valve 17A can switch between a first connection position (the right position) in which the locking passage R5 and the communication passage R7 are connected and a second connection position (the left position) in which the releasing passage R6 and the communication passage R7 are connected.

The first release valve 17A is biased toward the first connection position in a non-operating state of the operating unit 14 and is pilot-operated from the first connection position toward the second connection position according to the magnitude of the boom-lowering pilot pressure output from the operating unit 14.

As illustrated in FIGS. 2 and 3, in the non-operating state of the operating unit 14 (when the first release valve 17A is at the first connection position), the communication passage R7 and the cylinder-side passage R32 are connected through the locking passage R5. In this state, since the pressure in the communication passage R7 and the pressure in the cylinder-side passage R32 are the same, the valve element 16*a* is disposed at the locking position due to the biasing force of the spring 16*b* and a difference in the pressure-receiving area of both inner surfaces 16*d* and 16*e* and the base end surface 16*f* of the valve element 16*a*.

In the course in which a boom lowering operation of the operating unit 14 starts and the boom lowering operation amount increases, the first release valve 17A moves from the first connection position to the second connection position continuously. As a result, the area of an opening that connects the locking passage R5 and the communication passage R7 decreases continuously and the area of an opening that connects the releasing passage R6 (tank T) and the communication passage R7 increases continuously. That is, in the course in which the boom lowering operation amount increases, the pressure in the cylinder-side passage R32 increases continuously in relation to the pressure in the communication passage R7.

When the pressure in the cylinder-side passage R32 increases in this manner, an upward force acting on the valve element 16*a* increases due to a difference in the pressure-receiving area of both inner surfaces 16*d* and 16*e* of the valve element 16*a*. On the other hand, when the pressure in the communication passage R7 decreases, a downward force acting on the base end surface 16*f* of the valve element 16*a* decreases. When a difference pressure (operating pressure) between the pressure in the cylinder-side passage R32 and the pressure in the communication passage R7 exceeds a release pressure defined by the biasing force of the spring 16*b*, the valve element 16*a* moves to the unlocking position as illustrated in FIG. 4.

That is, the release valves 17A and 17B, the locking passage R5, the releasing passage R6, and the communication passage R7 form an operating pressure output unit that outputs operating pressure so that the larger operating pressure is output to the lock valves 16A and 16B as the operation amount of the operating unit 14 increases.

Figure 4:
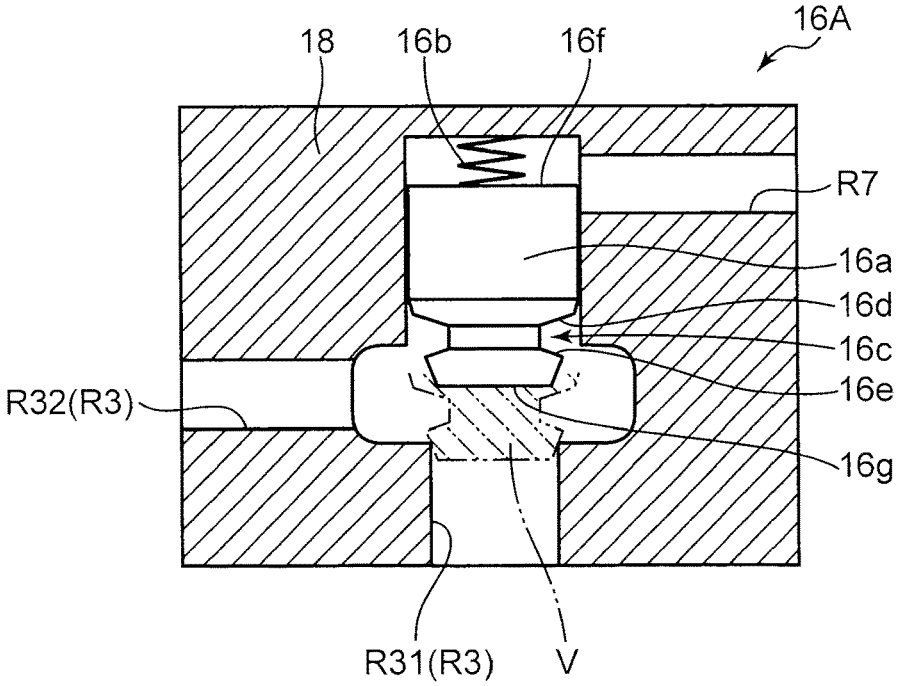
FIG. 4 is a cross-sectional view illustrating a schematic configuration of the lock valve illustrated in FIG. 2 and illustrating a state in which the valve element is disposed at an unlocking position.

Here, when the valve element 16*a* moves from the locking position to the unlocking position, as illustrated in FIG. 4, a space V in which hydraulic oil can flow according to the movement amount of the valve element 16*a* is formed in the passage of the hydraulic oil.

Due to this, when the valve elements 16*a* of both lock valves 16A and 16B move from the locking position to the unlocking position simultaneously, a large space which is the sum of the spaces V formed with the movement of the respective valve elements 16*a* is formed in the passage of the hydraulic oil instantly. For example, as indicated by phantom lines in FIG. 6, if both valve elements 16*a* are moved simultaneously when the boom-lowering pilot pressure reaches pressure L1, the rod of the boom cylinder 8 moves with a large stroke St1. As a result, a large shock occurs.

In order to prevent this shock, the biasing force of the spring 16*b* of the first lock valve 16A and the biasing force of the spring 16*b* of the second lock valve 16B are set to different values.

Figure 6:
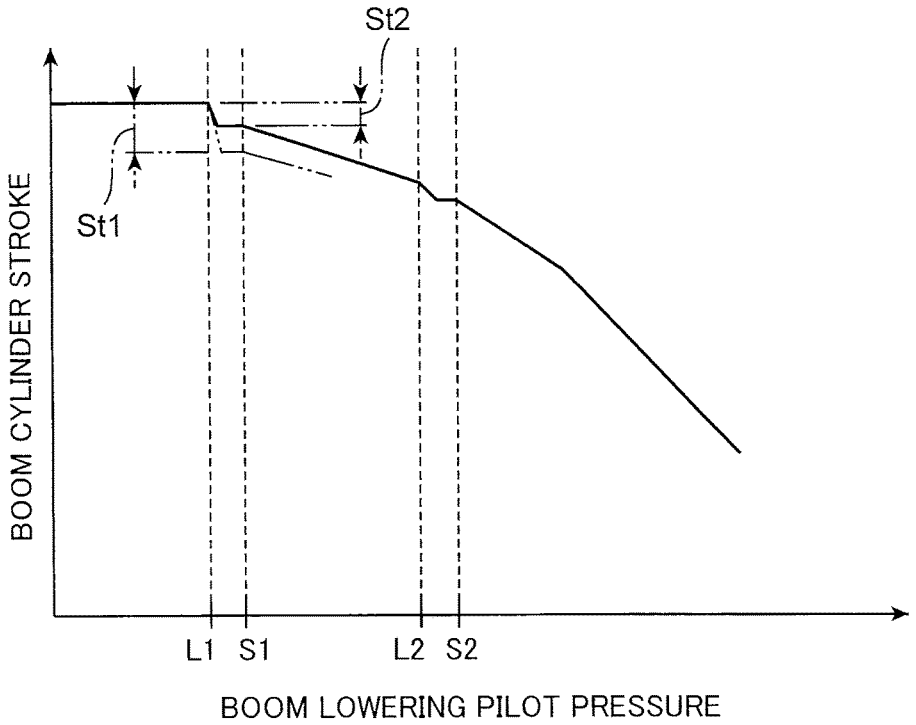
FIG. 6 is a graph illustrating the relation between a boom-lowering pilot pressure and stroke of a boom cylinder.

Specifically, as illustrated in FIG. 6, the spring 16*b* of the first lock valve 16A has biasing force set such that the first lock valve 16A moves from the locking position to the unlocking position when the boom-lowering pilot pressure reaches the pressure L1. The spring 16*b* of the second lock valve 16B has biasing force set such that the second lock valve 16B moves from the locking position to the unlocking position when the boom-lowering pilot pressure reaches pressure L2 larger than the pressure L1.

By doing so, since the two valve elements 16*a* can be moved to the unlocking position at different points in time, the stroke of the boom cylinder 8 when the boom-lowering pilot pressure reaches the pressure L1 is reduced to stroke St2 smaller than the stroke St1.

Moreover, both control valves 15A and 15B have such opening characteristics that the control valves are switched from the neutral position (stopped state) to the boom lowering position (discharge state) after one of both lock valves 16A and 16B connected thereto is operated.

Figure 5:
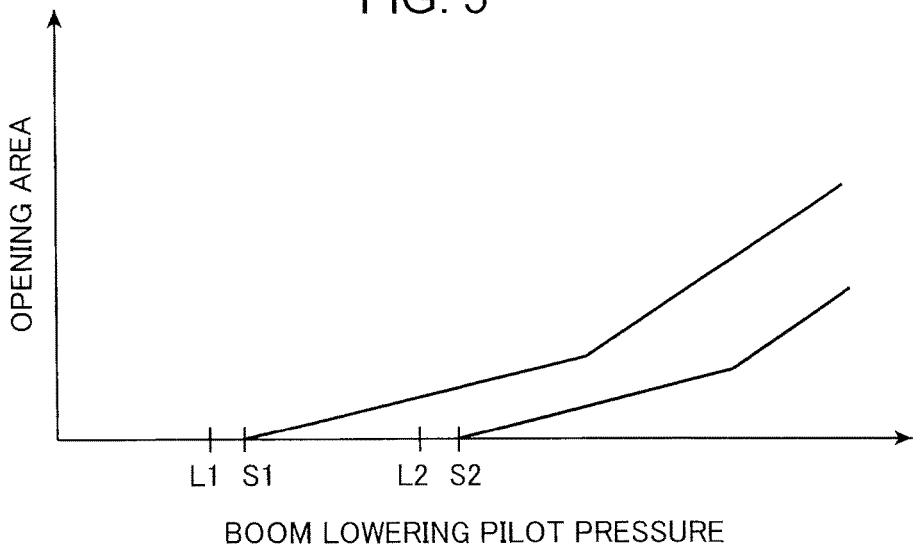
FIG. 5 is a graph illustrating opening characteristics of first and second control valves illustrated in FIG. 2 and operation characteristics of the lock valve.

Specifically, as illustrated in FIG. 5, the first control valve 15A starts moving from the neutral position to the boom lowering position when the boom-lowering pilot pressure reaches pressure S1 larger than the pressure L1. The second control valve 15B starts moving from the neutral position to the boom lowering position when the boom-lowering pilot pressure reaches pressure S2 larger than the pressure L2. These settings are realized by adjusting the spring that biases both control valves 15A and 15B toward the neutral position.

Thus, in a state in which both lock valves 16A and 16B are operated to the unlocking position, the speed of the boom cylinder 8 can be reliably controlled by both control valves 15A and 15B.

Further, the boom-lowering pilot pressure L2 at which the second lock valve 16B is operated is set to be larger than the boom-lowering pilot pressure S1 at which the first control valve 15A starts moving to the boom lowering position. In this manner, since the second lock valve 16B is operated during operation of the boom cylinder 8, a change in the speed of the rod of the boom cylinder 8 associated with the movement of the second lock valve 16B is rarely sensed as compared to when the second lock valve 16B is operated during stoppage of the boom cylinder 8.

As described above, the two valve elements 16*a* move from the locking position to the unlocking position at different points in time. Thus, it is possible to prevent a large space in which hydraulic oil can flow from being formed instantly in the passage of the hydraulic oil. Moreover, it is possible to prevent the occurrence of a large shock with movement of the rod of the boom cylinder 8.

Therefore, by adjusting the moving timings of the valve elements 16*a* of the two lock valves 16A and 16B, it is possible to reduce unpleasant feeling that an operator may experience.

According to the first embodiment, it is possible to obtain the following advantages.

The two valve elements 16*a* can be moved sequentially according to a difference in biasing force of springs 16*b* by utilizing an increase in the operating pressure (a difference pressure between the pressure in the cylinder-side passage R32 and the pressure in the communication passage R7) associated with an increase in the operation amount of the operating unit 14 without performing special control using a detection value or the like by sensor.

For example, when the first control valve 15A is switched to the boom lowering position before the first lock valve 16A is operated, hydraulic oil in the head-side chamber of the boom cylinder 8 may be discharged abruptly through the first control valve 15A when the first lock valve 16A is moved to the unlocking position.

In contrast, according to the first embodiment, both control valves 15A and 15B are switched to the boom lowering position after one of both lock valves 16A and 16B connected thereto is operated. Thus, it is possible to suppress the hydraulic oil in the head-side chamber from being discharged through both control valves 15A and 15B abruptly.

The second lock valve 16B is operated to the releasing position after the first lock valve 16A is operated to the unlocking position and the first control valve 15A is switched to the boom lowering position (that is, during the operation of the boom cylinder 8). Due to this, a change in the speed of the rod of the boom cylinder 8 associated with the operation of the lock valve 16B is rarely sensed as compared to when the second lock valve 16B is operated during the stoppage of the boom cylinder 8.

Figure 7:
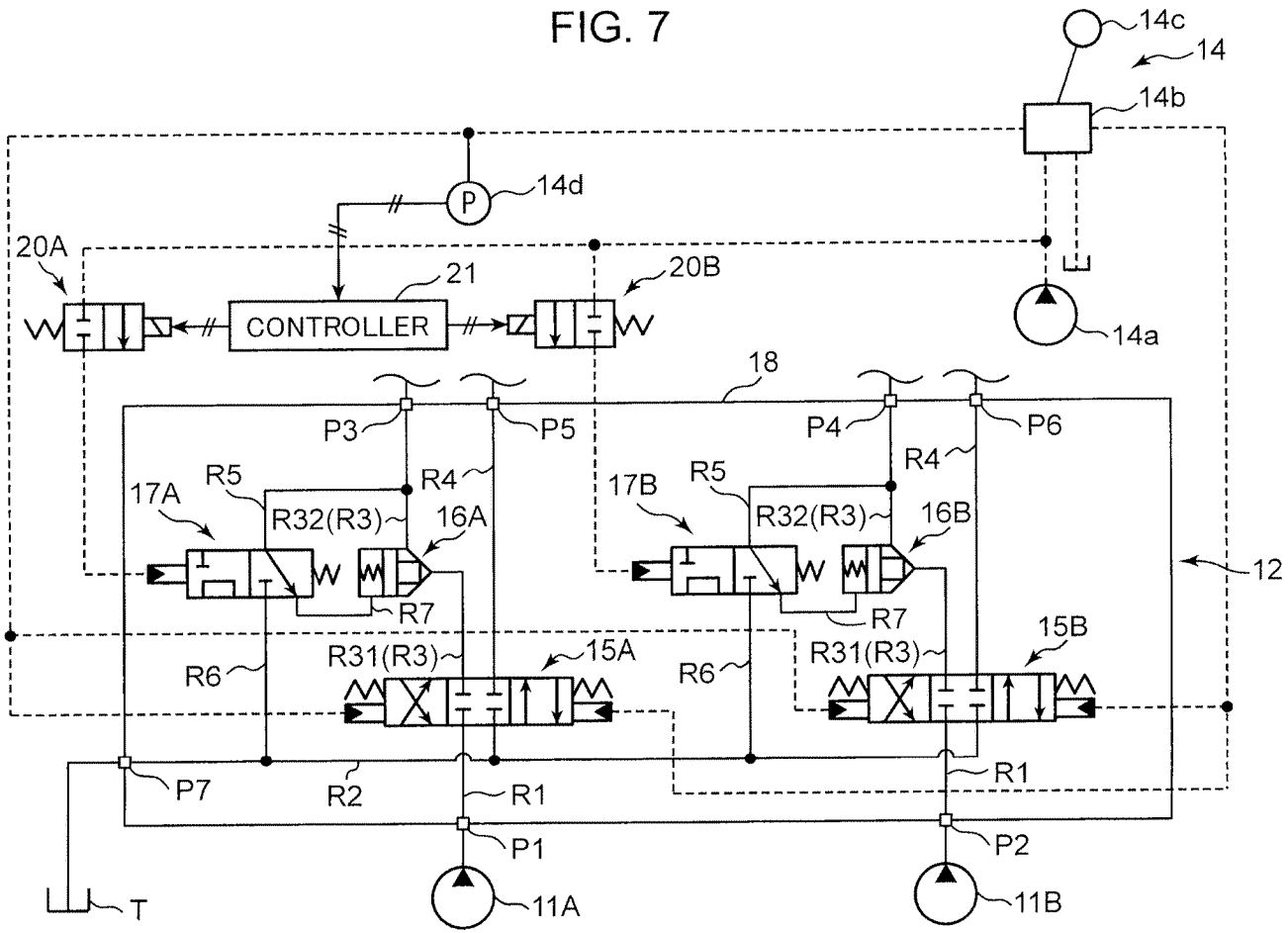
FIG. 7 is a circuit diagram illustrating a hydraulic system of a hydraulic excavator according to a second embodiment of the present invention.
Figure 8:
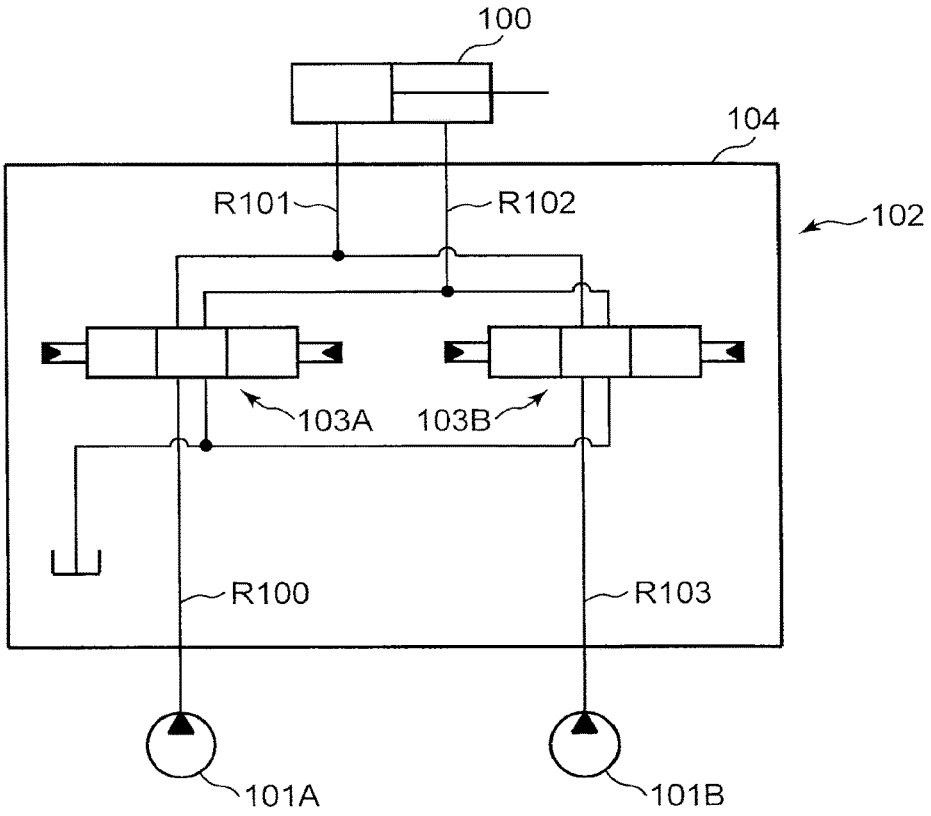
PRIOR ART FIG. 8
FIG. 8 is a circuit diagram illustrating a conventional construction machine.

Second Embodiment (FIG. 7)

Hereinafter, a hydraulic system according to a second embodiment of the present invention will be described with reference to FIG. 7. The same constituent elements as those of the first embodiment will be denoted by the same reference numerals and the description thereof will omitted. In FIG. 7, a portion of both pipelines 13*a* and 13*b* and the boom cylinder 8 are not depicted.

The hydraulic system according to the second embodiment includes a first electromagnetic valve 20A provided between a discharge passage of the pilot pump 14*a* and a pilot port of the first release valve 17A, a second electromagnetic valve 20B provided between a discharge passage of the pilot pump 14*a* and a pilot port of the second release valve 17B, a pressure sensor (operation detector) 14*d* configured to detect a boom lowering operation amount (magnitude of pilot pressure) of the operating unit 14, and a controller 21 configured to output an electrical signal (unlock signal) to both electromagnetic valves 20A and 20B when the pressure sensor 14*d* detects a boom lowering operation.

Both electromagnetic valves 20A and 20B can switch between a supply position at which the hydraulic oil from the pilot pump 14*a* is supplied to the pilot ports of both release valves 17A and 17B and a supply stop position at which the supply is stopped.

Both electromagnetic valves 20A and 20B are biased to the supply stop position when an electrical signal is not output from the controller 21 and are switched to the supply position when an electrical signal is received from the controller 21.

When both electromagnetic valves 20A and 20B are switched to the supply position, both release valves 17A and 17B are switched from the first connection position to the second connection position. As a result, both lock valves 16A and 16B are operated to the unlocking position.

That is, the first electromagnetic valve 20A, the first release valve 17A, the locking passage R5, the releasing passage R6, and the communication passage R7 form a command output unit configured to output a movement command for moving the valve element 16*a* to the unlocking position to the first lock valve 16A.

Similarly, the second electromagnetic valve 20B, the second release valve 17B, the locking passage R5, the releasing passage R6, and the communication passage R7 form a command output unit configured to output a movement command for moving the valve element 16*a* to the unlocking position to the second lock valve 16B.

The controller 21 can output an unlock signal for causing the two command output units to output a movement command to the two command output units (both electromagnetic valves 20A and 20B) at different points in time when the pressure sensor 14*d* detects a boom lowering operation.

Specifically, the controller 21 outputs the unlock signal when the operation amount (magnitude of pilot pressure) of the operating unit 14 detected by the pressure sensor 14*d* exceeds a predetermined threshold value. Here, the threshold values for the unlock commands are set to different values with respect to the two command output units.

In the second embodiment, the biasing force of the springs 16*b* of both lock valves 16A and 16B may be set to different values as long as the two valve elements 16*a* move to the unlocking position at different points in time according to the unlock command from the controller 21. However, the biasing force of both springs 16*b* is preferably set to the same value when the two valve elements 16*a* are managed so as to move at different points in time.

As described above, according to the second embodiment, it is possible to adjust the moving timings of the two valve elements 16*a* by changing the time at which the controller 21 outputs the unlock signal without changing the mechanical configuration.

Moreover, a plurality of valve elements may be moved sequentially according to a difference in threshold value using an increase in the operation amount of the operating unit 14 without providing a timer or the like separately.

The present invention is not limited to the above-described embodiments and may employ the following configurations, for example.

In the embodiments, although two control valves 15A and 15B and two lock valves 16A and 16B are provided, the number of control valves and lock valves is not limited to two but may be three or more.

In the embodiments, although the control valves 15A and 15B that control the supply of hydraulic oil to the boom cylinder 8 and the discharge of hydraulic oil from the boom cylinder 8 are provided as an example of a switching valve, the switching valve is not limited to the valve that controls the supply of hydraulic oil to the boom cylinder 8 and the discharge of hydraulic oil from the boom cylinder 8.

For example, the hydraulic excavator 1 may include the control valve that controls the supply of hydraulic oil to the boom cylinder 8 and the discharge of hydraulic oil from the boom cylinder 8 and a regeneration valve provided in an intermediate portion of a regeneration passage that connects the head-side chamber of the boom cylinder 8 and another hydraulic actuator (a hydraulic cylinder, a hydraulic motor, or the like) as the switching valve. In this case, the regeneration valve may be configured to be capable of switching between a discharge state in which the discharge of the hydraulic oil discharged from the head-side chamber of the boom cylinder 8 is allowed and a stopped state in which the discharge of the hydraulic oil is stopped. By switching the regeneration valve to the discharge state, returning oil by the boom-lowering operation can be used for operation of the other hydraulic actuator.

Moreover, the hydraulic excavator 1 may include the control valve that controls the supply of hydraulic oil to the boom cylinder 8 and the discharge of hydraulic oil from the boom cylinder 8 and a recycle valve provided in an intermediate portion of a recycle passage that connects the head-side chamber of the boom cylinder 8 and the rod-side chamber as the switching valve. In this case, the recycle valve may be configured to be capable of switching between a discharge state in which the discharge of the hydraulic oil discharged from the head-side chamber of the boom cylinder 8 is allowed and a stopped state in which the discharge of the hydraulic oil is stopped. By switching the recycle valve to the discharge state, returning oil by the boom-lowering operation can be supplied to the rod side of the boom cylinder.

Further, the hydraulic excavator 1 may include the control valve that controls the supply of hydraulic oil to the boom cylinder 8 and the discharge of hydraulic oil from the boom cylinder 8 and a discharge valve provided in an intermediate portion of a passage that connects the head-side chamber of the boom cylinder 8 and the tank as the switching valve. In this case, the discharge valve may be configured to be capable of switching between an discharge state in which the discharge of the hydraulic oil discharge from the head-side chamber of the boom cylinder 8 is allowed and a stopped state in which the discharge of the hydraulic oil is stopped. By switching the discharge valve to the discharge state, the discharge of the oil returning from the boom cylinder 8 can be controlled independently from the control valve.

Moreover, the switching valve may be configured to be capable of adjusting the flow rate of the hydraulic oil from the head-side chamber of the boom cylinder 8.

In the embodiments, the boom 5 is illustrated as an example of a driven body that can rotate about the horizontal axis in the raising and lowering directions. However, the driven body is not limited to the boom 5 and the present invention can be applied using the arm 6 as the driven body. In this case, the arm cylinder 9 corresponds to the hydraulic cylinder.

In the first embodiment, although the operating pressure output unit formed by both release valves 17A and 17B, the locking passage R5, the releasing passage R6, and the communication passage R7 is illustrated, the operating pressure output unit is not limited to this.

For example, when a lock valve that is operated directly with the pilot pressure from the operating unit 14 is employed, the operating unit 14 itself may be used as the operating pressure output unit. That is, the pilot pressure output from the operating unit 14 may be used as the operating pressure for moving the valve element 16*a*.

In the first embodiment, the second lock valve 16B is operated after the first lock valve 16A is operated and the first control valve 15A starts moving to the boom lowering position. However, the second lock valve 16B may be operated before the first control valve 15A is operated.

In the second embodiment, an example in which the controller 21 outputs an unlock command for moving the valve element 16*a* when the operation amount of the operating unit 14 exceeds a predetermined threshold value has been described. However, a method of determining the timing at which the controller 21 outputs the unlock command is not limited to this.

For example, a timer may be provided separately, and the controller 21 may output an unlock signal whenever a predetermined period elapses from the time when the operation of the operating unit is detected in a state in which the operation of the operating unit 14 is detected.

Moreover, the construction machine is not limited to the hydraulic excavator but may be a crane and a dismantling machine. Further, the construction machine is not limited to a hydraulic construction machine but may be a hybrid construction machine.

The specific embodiments described above mainly include inventions having following configurations.

In order to solve the problems, the present invention provides a construction machine including: a driven body configured to rotate about a horizontal axis in a raising direction and a lowering direction; a hydraulic cylinder that rotates and drives the driven body; a plurality of switching valves that is connected to, among a rod-side chamber and a head-side chamber of the hydraulic cylinder, a discharge-side chamber from which hydraulic oil is discharged during rotation of the driven body in the lowering direction, and that is configured to switch between a discharge state in which the discharge of the hydraulic oil from the discharge-side chamber is allowed and a stopped state in which the discharge of the hydraulic oil is stopped; an operating unit configured to switch the plurality of switching valves from the stopped state to the discharge state; a plurality of lock valves each provided between each of the plurality of switching valves and the discharge-side chamber in order to lock the rotation of the driven body in the lowering direction in a non-operating state of the operating unit; and an operation control unit that controls the operation of the plurality of lock valves, wherein each of the plurality of lock valves includes a valve element configured to move between a locking position at which the discharge of the hydraulic oil from the discharge-side chamber is restricted and an unlocking position at which the discharge of the hydraulic oil from the discharge-side chamber is allowed, and the operation control unit controls the operation of the plurality of lock valves so that the plurality of valve elements moves from the locking position to the unlocking position at different points in time when the operating unit is operated.

When a plurality of valve elements moves from a locking position to an unlocking position simultaneously, a large space which is the sum of the spaces formed with the movement of the respective valve elements is formed in the passage of the hydraulic oil instantly. When hydraulic oil flows into this space, the rod of the boom cylinder moves and a large shock occurs.

In contrast, according to the present invention, the plurality of valve elements moves from the locking position to the unlocking position at different points in time. Thus, it is possible to prevent a large space in which hydraulic oil can flow from being formed instantly in the passage of the hydraulic oil and to prevent the occurrence of a large shock as described above.

That is, according to the present invention, by adjusting the moving timings of the valve elements of the plurality of lock valves, it is possible to reduce unpleasant feeling that an operator may experience.

In the construction machine, the operation control unit may include: a plurality of biasing members that biases the plurality of valve elements toward the locking position; and an operating pressure output unit configured to output an operating pressure for moving the plurality of valve elements to the unlocking position, to the plurality of lock valves, and the operating pressure output unit may output operating pressure so that the larger operating pressure is output as an operation amount of the operating unit increases, and biasing forces of the plurality of biasing members are different from each other.

According to this aspect, the plurality of valve elements can be moved sequentially according to a difference in biasing force of the biasing member by utilizing an increase in the operating pressure associated with an increase in the operation amount of the operating unit without performing special control using a detection value or the like by sensor.

In the construction machine, the operation control unit may include: an operation detector configured to detect an operation of the operating unit; a plurality of command output units configured to output a movement command for moving the valve elements to the unlocking position, to the plurality of lock valves; and a controller configured to output an unlock signal for causing the plurality of command output units to output the movement command, to the plurality of command output units at different points in time when the operation detector detects the operation of the operating unit.

According to this aspect, it is possible to adjust the moving timings of the plurality of valve elements by changing the timing at which the controller outputs the unlock signal without changing the mechanical configuration.

Here, the controller may output the unlock signal whenever a predetermined period elapses from the time when the operation of the operating unit is detected in a state in which the operation of the operating unit is detected. However, in this case, a timer is required separately.

Thus, in the construction machine, the operation detector is configured to detect an operation amount of the operating unit, the controller may preferably output the unlock signal when the operation amount of the operating unit detected by the operation detector exceeds a predetermined threshold value, and threshold values for unlock commands for the plurality of command output units may preferably be set to different values.

According to this aspect, the plurality of valve elements can be moved sequentially according to a difference in threshold value using an increase in the operation amount of the operating unit without providing a timer or the like separately.

In the construction machine, when the operating unit is operated, each of the plurality of switching valves may preferably have such opening characteristics that the switching valve is switched from the stopped state to the discharge state after one of the plurality of lock valves connected thereto is operated.

When the switching valve is switched to the discharge state before the lock valve connected thereto is operated, the hydraulic oil in the discharge-side chamber may be discharged through the switching valve abruptly when the lock valve is operated to the unlocking position.

In contrast, according to this aspect, since the switching valve is switched to the discharge state after the lock valve connected thereto is operated, it is possible to suppress the hydraulic oil in the discharge-side chamber from being discharged through the switching valve abruptly.

Here, the lock valves other than the initially operated lock valve, that is operated initially among the plurality of lock valves, may be operated after the initially operated lock valve is moved to the unlocking position and before the switching valve connected to the initially operated lock valve is switched to the discharge state.

However, in this case, since the lock valves other than the initially operated lock valve are moved before the discharge of the hydraulic oil through the switching valve starts (that is, during the stoppage of the hydraulic cylinder), the operator may easily experience the shock of the hydraulic cylinder occurring due to the movement.

Thus, in the construction machine, when the operating unit is operated, the operation control unit may preferably control the operation of the plurality of lock valves so that, after a valve element of an initially operated lock valve that is operated initially among the plurality of lock valves is moved to the unlocking position and one of the plurality of switching valves connected to the initially operated lock valve is switched from the stopped state to the discharge state, lock valves other than the initially operated lock valve are operated.

According to this aspect, the lock valves other than the initially operated lock valve are operated to the unlocking position during the operation of the hydraulic cylinder. Due to this, a change in the speed of the rod of the hydraulic cylinder associated with the operation of lock valves other than the initially operated lock valve is rarely sensed as compared to when the lock valves other than the initially operated lock valve is operated during the stoppage of the hydraulic cylinder.

This application is based on Japanese Patent application No. 2014-155140 filed in Japan Patent Office on Jul. 30, 2014, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A construction machine comprising:

a driven body configured to rotate about a horizontal axis in a raising direction and a lowering direction;

a hydraulic cylinder that rotates and drives the driven body, the hydraulic cylinder having a rod-side chamber and a head-side chamber;

a plurality of switching valves that are connected to either the rod-side chamber or the head-side chamber, wherein either the rod-side chamber or the head-side chamber is defined as a discharge-side chamber when hydraulic oil is discharged therefrom during rotation of the driven body in the lowering direction, the plurality of switching valves being configured to switch between a discharge state in which the discharge of the hydraulic oil from the discharge-side chamber is allowed and a stopped state in which the discharge of the hydraulic oil is stopped;

an operating unit to be operated by an operator to switch the plurality of switching valves from the stopped state to the discharge state;

a plurality of lock valves each provided between each of the plurality of switching valves and the discharge-side chamber in order to lock the rotation of the driven body in the lowering direction during the time when the operating unit is not operated by the operator; and an operation control unit that controls the operation of the plurality of lock valves, wherein, wherein each of the plurality of lock valves includes a valve element configured to move between a locking position at which the discharge of the hydraulic oil from the discharge-side chamber is restricted and an unlocking position at which the discharge of the hydraulic oil from the discharge-side chamber is allowed, and wherein the operation control unit controls the operation of the plurality of lock valves so that the plurality of valve elements moves from the locking position to the unlocking position at different points in time when the operating unit is operated by the operator.

2. The construction machine according to claim 1, wherein the operation control unit includes:

a plurality of biasing members that biases the plurality of valve elements toward the locking position; and an operating pressure output unit configured to output an operating pressure for moving the plurality of valve elements to the unlocking position, to the plurality of lock valves, and the operating pressure output unit outputs an increased operating pressure as the operation amount of the operating unit increases, and respective biasing forces of the plurality of biasing members are different from each other.

3. The construction machine according to claim 1, wherein the operation control unit includes:

an operation detector configured to detect an operation of the operating unit;

a plurality of command output units configured to output a movement command for moving the valve elements to the unlocking position, to the plurality of lock valves; and a controller configured to output an unlock signal for causing the plurality of command output units to output the movement command, to the plurality of command output units at different points in time when the operation detector detects the operation of the operating unit.

4. The construction machine according to claim 3, wherein the operation detector is configured to detect the operation amount of the operating unit, the controller outputs the unlock signal when the operation amount of the operating unit detected by the operation detector exceeds a predetermined threshold value, and the plurality of command output units are set with different threshold values for unlock command.

5. The construction machine according to claim 1, wherein when the operating unit is operated, each of the plurality of switching valves has such opening characteristics that the switching valve is switched from the stopped state to the discharge state after one of the plurality of lock valves connected thereto is operated.

6. The construction machine according to claim 1, wherein when the operating unit is operated, the operation control unit controls the operation of the plurality of lock valves so that, after a valve element of an initially operated lock valve that is operated initially among the plurality of lock valves is moved to the unlocking position and one of the plurality of switching valves connected to the initially operated lock valve is switched from the stopped state to the discharge state, lock valves other than the initially operated lock valve are operated.

* * * * *